US008496401B1

(12) United States Patent
Van Beek et al.

(10) Patent No.: US 8,496,401 B1
(45) Date of Patent: Jul. 30, 2013

(54) FEEDER FLOOR PROTECTION SYSTEM FOR PAVING MACHINE

(75) Inventors: John Ross Van Beek, Maple Grove, MN (US); Aaron Matthew Case, St. Michael, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 16 days.

(21) Appl. No.: 13/349,914

(22) Filed: Jan. 13, 2012

(51) Int. Cl.
*E01C 19/22* (2006.01)

(52) U.S. Cl.
USPC ..... 404/108; 404/118

(58) Field of Classification Search
USPC ..... 404/101, 108, 118
See application file for complete search history.

(56) References Cited

U.S. PATENT DOCUMENTS 6,086,287 A * 7/2000 Sharpe et al. ..... 404/75
6,193,437 B1 2/2001 Heims
6,551,021 B2 * 4/2003 Baker ..... 404/118
6,595,719 B1 * 7/2003 Ohseki et al. ..... 404/118
2002/0106244 A1 8/2002 Baker

FOREIGN PATENT DOCUMENTS

CN 101956362 1/2011

OTHER PUBLICATIONS

Vögele; drawing, published 2011, 06-28, 1 page.

* cited by examiner

*Primary Examiner* — Gary Hartmann
(74) *Attorney, Agent, or Firm* — Liell & McNeil

(57) ABSTRACT

A feeder floor protection system for a paving machine includes at least a first pair of wear plates covering a majority of a feeder floor. Each wear plate has at least two frame abutment features and at least two plate abutment features. Each plate abutment feature includes at least two non-contiguous lateral movement restriction surfaces offset from a centerline of the paving machine and at least one fore and aft movement restriction surface in a plane perpendicular to the centerline. The lateral movement restriction surfaces of a first plate of the pair of wear plates abut the lateral movement restriction surfaces of a second plate of the pair of wear plates. The fore and aft movement restriction surface of the first plate abuts the fore and aft movement restriction surface of the second plate.

20 Claims, 7 Drawing Sheets

FEEDER FLOOR PROTECTION SYSTEM FOR PAVING MACHINE

TECHNICAL FIELD

The present disclosure relates generally to a feeder floor protection system for a paving machine, and more particularly to a feeder floor protection system including wear plates having at least two frame abutment features and at least two plate abutment features.

BACKGROUND

A paving machine, such as an asphalt paver, is generally a self-propelled machine designed to receive, convey, distribute, and partially compact paving material, such as asphalt. Typically, the paving machine receives the paving material in a hopper positioned at the front of the machine, conveys the paving material from the hopper to the rear of the machine with parallel slat conveyors, distributes the paving material along a desired width, and compacts the paving material into a mat with a screed. Each slat conveyor that moves the paving material from the receiving hopper to the rear of the paving machine generally consists of two parallel slat chains with a multitude of transverse slats connected therebetween. Each slat chain is pulled by one of two sprockets mounted on a common shaft, which, in turn, is driven by an appropriate power source.

The paving material is typically asphalt, and consists of a black and highly viscous liquid or semi-solid. When used in road construction, asphalt usually functions as a binder for a gravel or rock base. The raw material mixture is referred to as a "bituminous aggregate" and the finished road surfacing material is usually called "asphalt concrete." The bituminous aggregate is typically stored and transported at temperatures around 150° Celsius to prevent hardening. Thus, the conveyor system used to channel the bituminous aggregate through a feeder area of the paving machine needs to withstand exposure to the high temperature and rough gravel or rock particles bound within the aggregate. The feeder floor, in particular, is subject to significant wear caused by the bituminous aggregate and, more specifically, conveyance of the aggregate through the feeder area.

Joseph Vogele AG, a company headquartered in Germany, offers feeder floor wear plates, as shown in the Vogele catalogue page submitted herewith, that may be positioned along the feeder floor. The Vogele wear plates have tabs positioned on outboard sides of the wear plates for engagement with slots formed within the frame of the paving machine. However, the Vogele wear plates do not include any inboard engagement features for "interlocking" laterally positioned plates with one another.

The present disclosure is directed to one or more of the problems or issues set forth above.

SUMMARY OF THE DISCLOSURE

In one aspect, a paving machine includes a hopper supported on a front portion of a frame and configured to channel paving material toward a feeder. A screed is coupled with the paving machine at a rear portion of the frame. The feeder includes a feeder floor and extends from the hopper to the screed. A conveyor has a conveyor portion positioned above the feeder floor for conveying the paving material through the feeder. A feeder floor protection system includes at least a first pair of wear plates covering a majority of the feeder floor. Each wear plate has at least two frame abutment features and at least two plate abutment features. Each plate abutment feature includes at least two non-contiguous lateral movement restriction surfaces offset from a centerline of the paving machine and at least one fore and aft movement restriction surface in a plane perpendicular to the centerline. The lateral movement restriction surfaces of a first plate of the pair of wear plates abut the lateral movement restriction surfaces of a second plate of the pair of wear plates. The fore and aft movement restriction surface of the first plate abuts the fore and aft movement restriction surface of the second plate. As used herein, the lateral movement restriction surfaces restrict movement of the wear plates perpendicular to the centerline, and the fore and aft movement restriction surfaces restrict movement of the wear plates parallel to the centerline.

In another aspect, a feeder floor protection system for a paving machine includes a wear plate having a uniform thickness and including a planar conveyor contact surface and a planar feeder floor contact surface. The conveyor contact surface and the feeder floor contact surface are bounded by a perimeter. At least two frame abutment features and at least two plate abutment features define a portion of the perimeter, with the frame abutment features and the plate abutment features being positioned on opposite sides of a longitudinal axis of the wear plate. Each of the frame abutment features and the plate abutment features includes at least two non-contiguous lateral movement restriction surfaces parallel with the longitudinal axis and at least one fore and aft movement restriction surface in a plane perpendicular to the longitudinal axis. A first frame abutment feature and a first plate abutment feature have a first identical longitudinal position along the longitudinal axis, while a second frame abutment feature and a second plate abutment feature have a second identical longitudinal position along the longitudinal axis. The first frame abutment feature has a reversed profile relative to the first plate abutment feature, and the second frame abutment feature has a reversed profile relative to the second plate abutment feature such that the wear plate is asymmetrical about the longitudinal axis.

In yet another aspect, a method of protecting a feeder floor of a paving machine includes a step of disposing at least a first pair of wear plates of a feeder floor protection system to cover a majority of the feeder floor, with each wear plate having at least two frame abutment features and at least two plate abutment features. Lateral movement of the wear plates relative to a centerline of the paving machine is restricted using non-contiguous lateral movement restriction surfaces of the plate abutment features of each wear plate, with the lateral movement restriction surfaces being offset from the centerline. Fore and aft movement of the wear plates relative to the centerline is restricted using fore and aft movement restriction surfaces of the plate abutment features of each wear plate, with the fore and aft movement restriction surfaces being in a plane perpendicular to the centerline.

DETAILED DESCRIPTION

Figure 1:
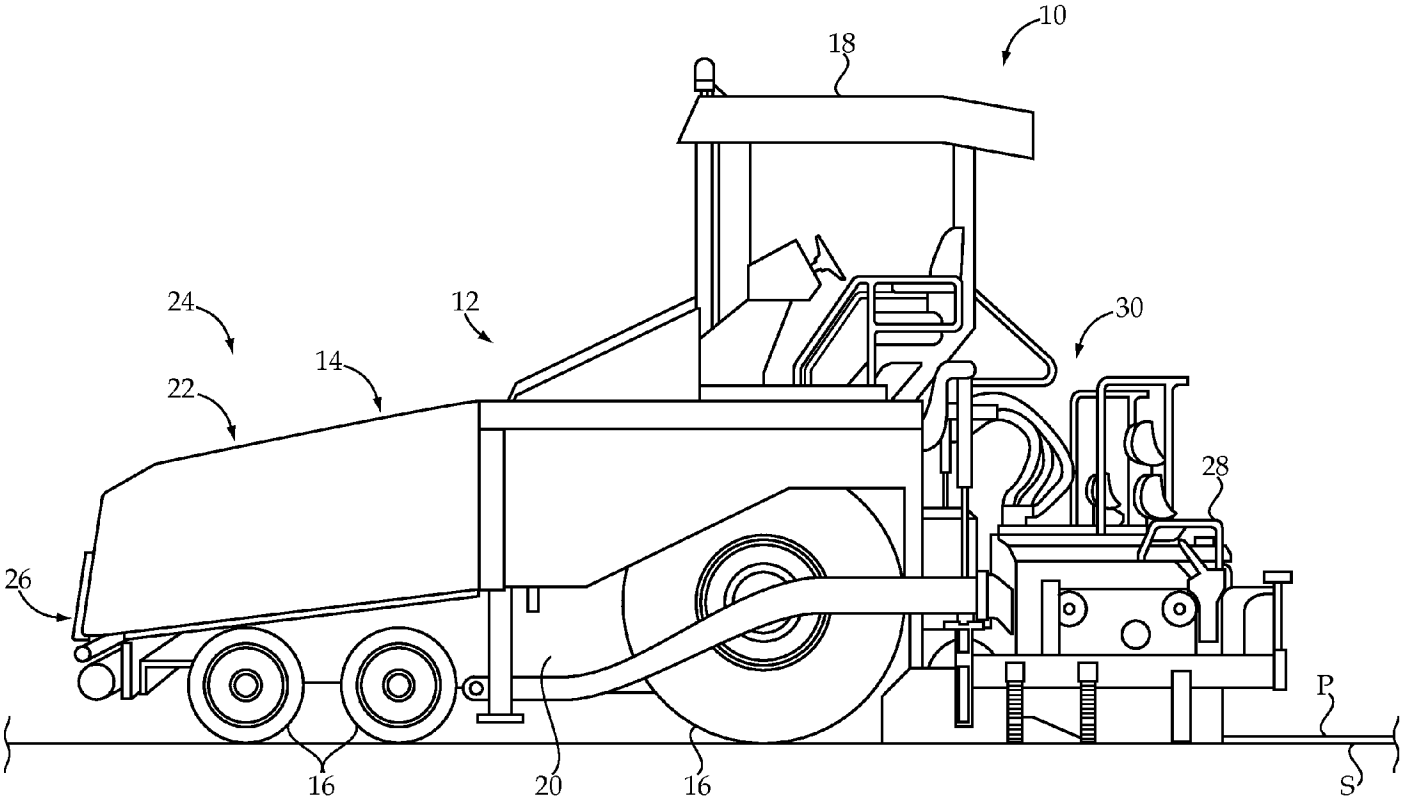
FIG. 1 is a side diagrammatic view of a paving machine, according to the present disclosure.

An exemplary embodiment of a paving machine 10 is shown generally in FIG. 1. The paving machine 10, which may also be referred to as an asphalt paver, may be any machine used to distribute a layer of paving material P on the surface S of a roadway or other area. The paving machine 10 generally includes a tractor portion 12 including a power source 14, such as an internal combustion engine, ground-engaging propulsion elements 16, some or all of which may be powered by the power source 14, and an operator control station 18. The power source 14, ground-engaging propulsion elements 16, and operator control station 18 may all be supported on a frame 20 of the machine 10. The frame 20 may also support various other components and systems, including a hopper 22 supported on a front portion 24 of the frame 20 for receiving the paving material P.

A conveyor 26, which will be discussed below with reference to FIG. 2, may also be supported on the frame 20 and may convey the paving material P received within the hopper 22 to a screed 28, such as a free floating screed, coupled with the paving machine 10, such as via tow arms, at a rear portion 30 of the frame 20. The screed 28 may distribute and, at least partially, compact the paving material P into a mat on a desired paving surface S. The tractor portion 12 of the paving machine 10 may also include hydraulic drives and controls, along with various other known paving machine components, for operating various systems and components of the paving machine 10. The screed portion 28 of the paving machine 10 may also include additional components and systems, such as, for example, leveling arms, vibrators, sensors, and controllers, as are known to those skilled in the art. Such additional systems and components are not within the scope of the present disclosure and, thus, will not be discussed herein in greater detail.

Figure 2:
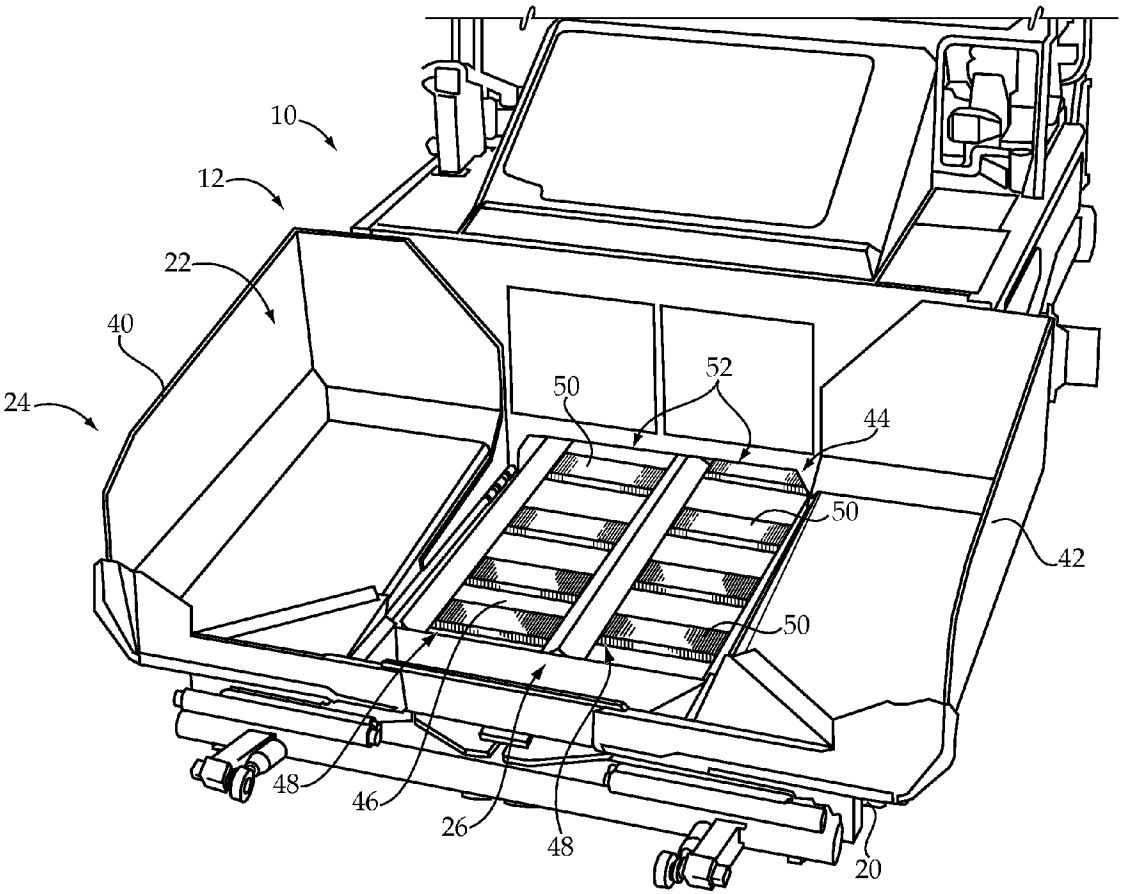
FIG. 2 is a perspective view of a front portion of the paving machine of FIG. 1, with portions removed to expose a feeder.

Turning now to FIG. 2, the hopper 22 may generally include two hopper walls 40 and 42 that are pivotable relative to the frame 20 to channel the paving material P, which may be received within the hopper 22 from a dump truck traveling in front of the paving machine 10, toward a feeder 44. The feeder 44, or feeder area, may generally represent the conveyance area of the paving machine 10 along which the paving material P is received at the front portion 24 of the machine 10 and transferred to the rear portion 30 of the machine 10. The feeder 44 includes a feeder floor 46, which may be defined by the frame 20, and may extend from the hopper 22 to the screed 28. As shown, the conveyor 26 may include two parallel slat chains 48 having a plurality of transverse slats 50 connected therebetween. Each slat chain 48 may be pulled by one or more sprockets (not shown), which may be mounted on a common shaft and driven by an appropriate power source. During operation of the conveyor 26, conveyor portions 52 are positioned above and moved along the feeder floor 46 to convey the paving material P through the feeder 44.

Figure 3:
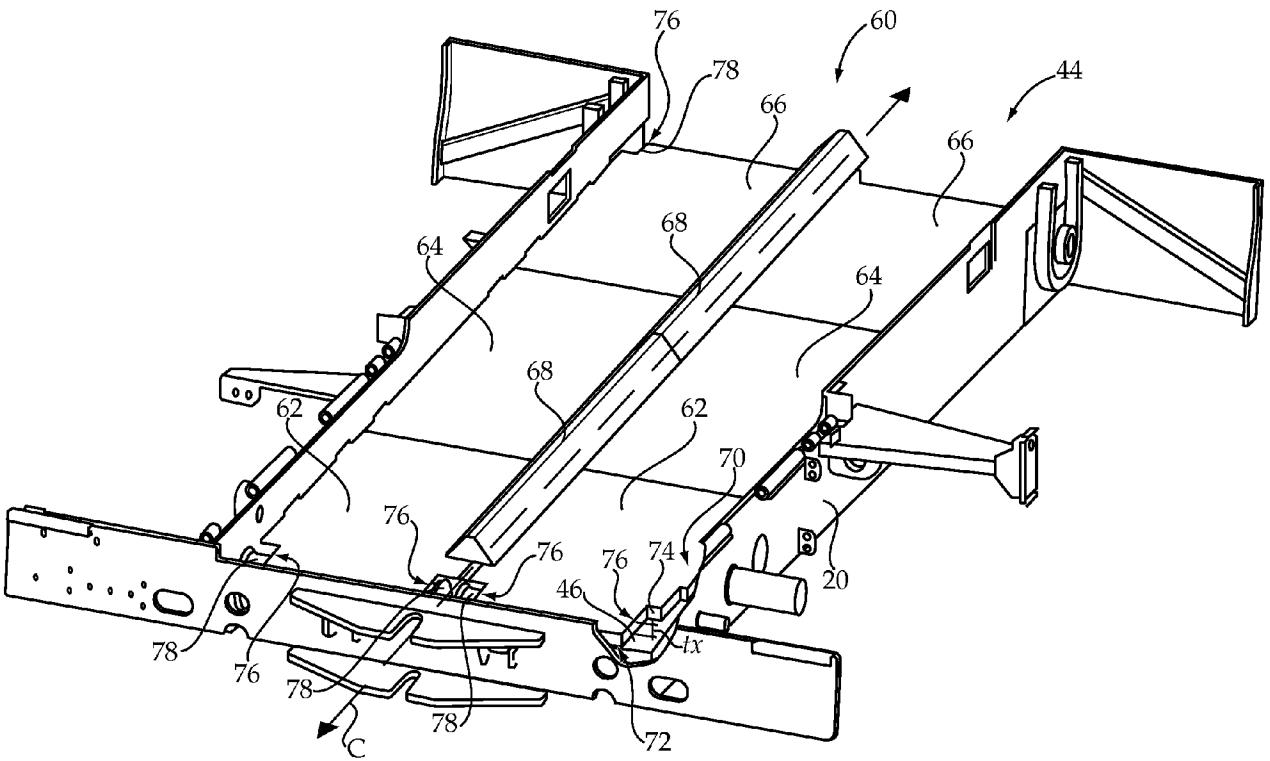
FIG. 3 is a perspective view of a frame of the paving machine of FIG. 1, having an exemplary embodiment of a feeder floor protection system positioned to cover a majority of the feeder floor, according to one aspect of the present disclosure.

An exemplary feeder floor protection system 60, according to one embodiment of the present disclosure, is shown in FIG. 3 and includes three pairs of laterally disposed wear plates 62, 64, and 66 and two center guards 68. Preferably, and as shown, each pair 62, 64, and 66 may be axially aligned relative to a centerline axis C of the paving machine 10. Although three pairs of wear plates 62, 64, and 66 are shown, it will become apparent below that the feeder floor protection system 60 may include as few as one pair of wear plates and may include additional pairs of wear plates as desired and depending on the particular application. According to all embodiments, however, it may be desirable for the pairs of wear plates 62, 64, and 66 to cover a majority of the feeder floor 46. As shown at a cutaway portion of the frame 20, each wear plate in the pairs of wear plates 62, 64, and 66 may have a uniform thickness tx and may include a planar conveyor contact surface 70 and a planar feeder floor contact surface 72 bounded by a perimeter 74. Further, wear plate cutouts, such as orthogonal cutouts 76, may be provided to accommodate components of the paving machine 10, such as, for example, sprockets or rollers 78 of the conveyor 26, located along or near the feeder floor 46.

Figure 4:
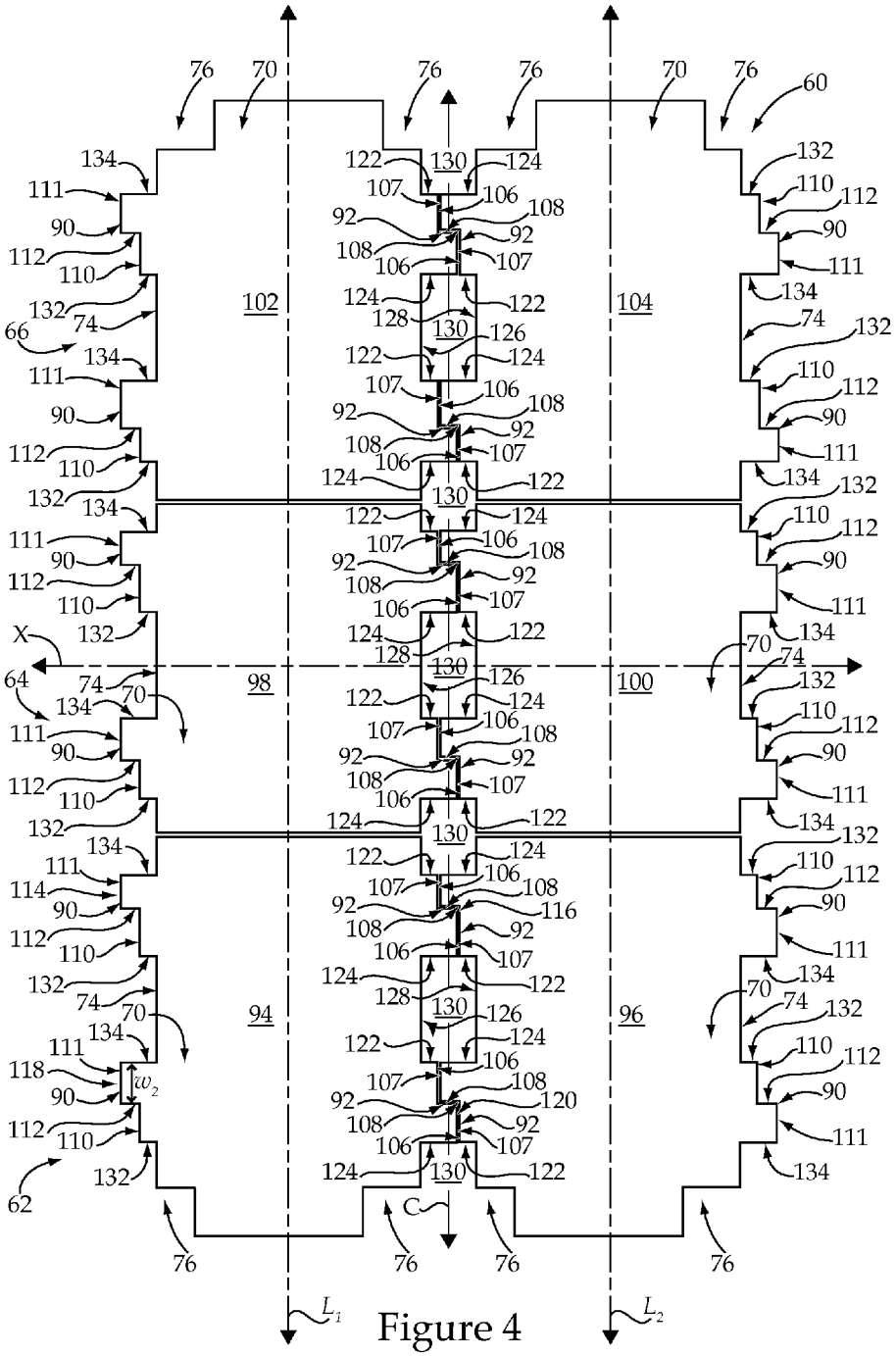
FIG. 4 is a plan view of the feeder floor protection system depicted in FIG. 3, shown with center guards removed.

At least two frame abutment features 90 and at least two plate abutment features 92 define a portion of the perimeter 74 of each wear plate in the wear plate pairs 62, 64, and 66, as shown in FIG. 4. According to the exemplary embodiment, the first pair of wear plates 62 includes laterally disposed wear plates 94 and 96, the second pair of wear plates 64 includes laterally disposed wear plates 98 and 100, and the third pair of wear plates 66 includes laterally disposed wear plates 102 and 104. As shown, each wear plate 94-104 may have a generally rectangular shape, with the frame abutment features 90 and the plate abutment features 92 positioned on opposite sides of a respective longitudinal axis $L_1$ or $L_2$ of the wear plate 94-104. The shapes of the wear plates 94-104, as should be appreciated, may vary depending on the particular application.

Each plate abutment feature 92 includes at least two non-contiguous lateral movement restriction surfaces 106, 107 offset from the centerline C of the paving machine 10 and at least one fore and aft movement restriction surface 108 in a plane X perpendicular, or transverse, to the centerline C. The wear plates 94-104 may be positioned such that corresponding surfaces 106, 107, and 108 of each pair 62, 64, and 66 abut. For example, the lateral movement restriction surface 106 of wear plate 94 may abut the lateral movement restriction surface 107 of wear plate 96, while the lateral movement restriction surface 107 of wear plate 94 may abut the lateral movement restriction surface 106 of wear plate 96. In addition, the fore and aft movement restriction surface 108 of wear plate 94 may abut the fore and aft movement restriction surface 108 of wear plate 96. As used herein, "abut" means to lie adjacent to, be next to, share a common boundary with, or touch. Further, the respective surfaces "abut" such that the lateral movement restriction surfaces 106 and 107 restrict movement of the wear plates 94-104 perpendicular to the centerline C, or parallel to plane X, and the fore and aft movement restriction surfaces 108 restrict movement of the wear plates 94-104 parallel to the centerline C.

The frame abutment features 90 may be similar to the plate abutment features 92 and may include at least two non-contiguous lateral movement restriction surfaces 110 and 111, which are parallel with the centerline C and respective longitudinal axis $L_1$ or $L_2$, and at least one fore and aft movement restriction surface 112, which lies in a plane, for example plane P, perpendicular, or transverse, to the centerline C and axis $L_1$ or $L_2$. As will be discussed below with reference to FIG. 6, the frame abutment features 90 may interact with the frame 20 to further restrict movement of the wear plates 94-104.

According to the exemplary embodiment, and with specific reference to wear plate 94, a first frame abutment feature 114 and a first plate abutment feature 116 may have a first identical longitudinal position along the centerline C, while a second frame abutment feature 118 and a second plate abutment feature 120 may have a second longitudinal position along the centerline C. Further, the first frame abutment feature 114 may have a reversed profile relative to the first plate abutment feature 116, while the second frame abutment feature 118 may have a reversed profile relative to the second plate abutment feature 120 such that the wear plate 94 is asymmetrical about the longitudinal axis $L_1$.

Each plate abutment feature 92 may include the non-contiguous lateral movement restriction surfaces 106 and 107, the fore and aft movement restriction surface 108, and opposing surfaces 122 and 124. The opposing surfaces 122 and 124 of the plate abutment features 92, along with the feeder floor 46 and adjoining sides 126, 128 of the wear plates 94-104, may define a plurality of cavities 130, which will be discussed in greater detail below. Each frame abutment feature 90 may include the non-contiguous lateral movement restriction surfaces 110 and 111, the fore and aft movement restriction surface 112, and opposing surfaces 132 and 134. Thus, due to the similarity and reversed profile of the abutment features 90 and 92, the plates in each pair of wear plates 62, 64, and 66 may be identical to one another and, thus, interchangeable. The wear plate pairs 62 and 66, positioned at either end of the feeder 44, may differ from the wear plate pair 64 positioned at a central location of the feeder 44 in that each of wear plates 94, 96, 102, and 104 include orthogonal cutouts 76 to accommodate sprockets or rollers 78 of the conveyor 26. Thus, it is possible that wear plates 94, 96, 102, and 104 may be identical to one another, while wear plates 98 and 100 may be identical to one another. If cutouts 76 are unnecessary, all of the wear plates 94-104 may be identical. It should be noted that, due to the reverse profile characteristic described above, the wear plates 94-104 may have a designated conveyor contact surface 70 and feeder floor contact surface 72, but, if identical, may be reoriented to provide interchangeability.

Figure 5:
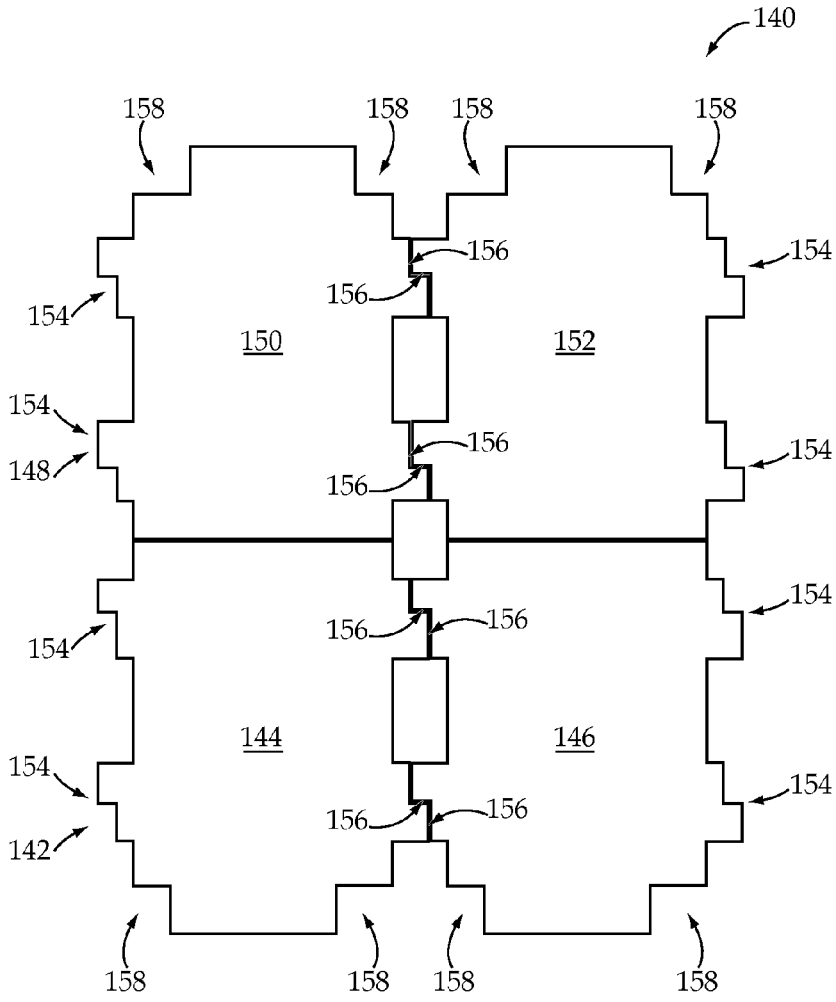
FIG. 5 is a plan view of an alternative feeder floor protection system, shown with center guards removed.

Turning now to FIG. 5, an alternative embodiment of a feeder floor protection system is shown generally at 140. The feeder floor protection system 140 is similar to the feeder floor protection system 60 described above; however, feeder floor protection system 140 includes a fewer number of plates. Specifically, the feeder floor protection system 140 may include a first pair of wear plates 142, including wear plates 144 and 146, axially aligned with a second pair of wear plates 148, including wear plates 150 and 152. Each of the wear plates 144, 146, 150, and 152 includes two frame abutment features 154 and two plate abutment features 156. The frame abutment features 154 and plate abutment features 156 are similar to the respective frame abutment features 90 and plate abutment features 92 of FIG. 4, and, thus, will not be discussed in further detail. Since only four wear plates 144, 146, 150, and 152 are used to cover a majority of the feeder floor 46 (shown in FIG. 2), each of the plates 144, 146, 150, and 152 is positioned at an end of the feeder 44 and, thus, may require orthogonal cutouts 158, as described above. According to the alternative embodiment, each of the wear plates 144, 146, 150, and 152 may be identical to one another.

Figure 6:
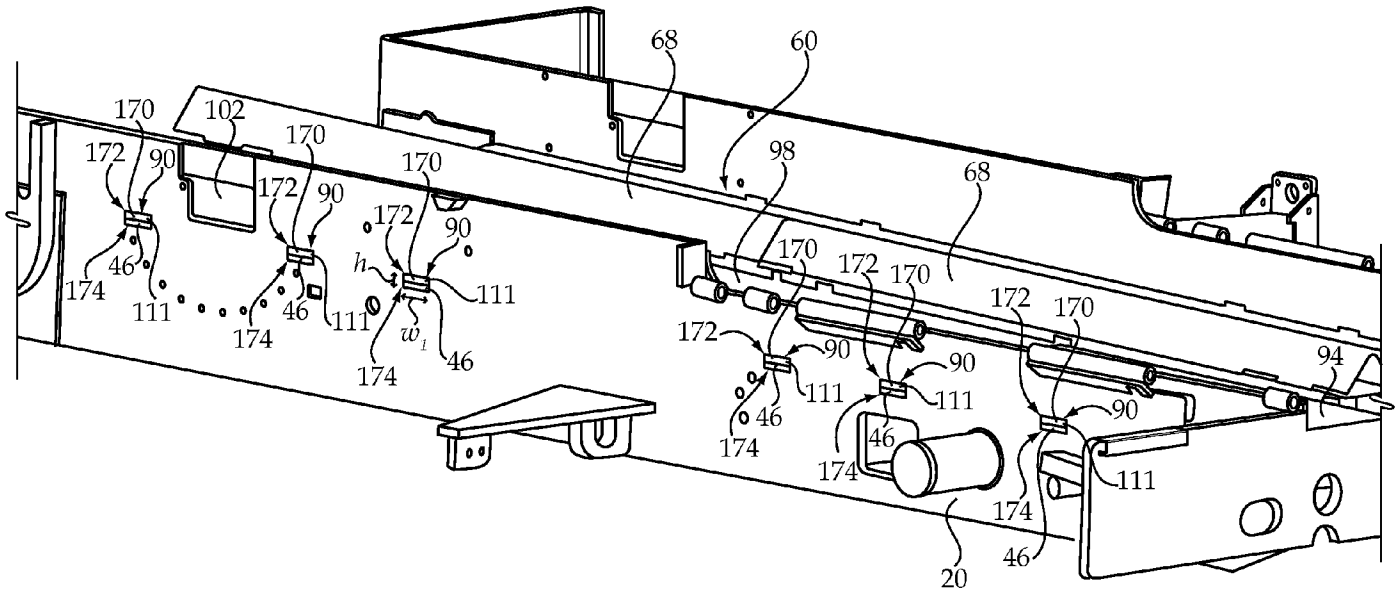
FIG. 6 is a perspective side view of the frame of the paving machine of FIG. 1, having the feeder floor protection system of FIGS. 3 and 4 installed thereon, according to another aspect of the present disclosure.

Turning now to FIG. 6, and with reference also to FIGS. 3 and 4, at least a portion of the frame abutment features 90 of each wear plate 94-104 may be received within elongated slots 170 formed in the frame 20. For example, outermost non-contiguous lateral movement restriction surfaces 111, along with portions of the fore and aft movement restriction surface 112 and opposing surface 134, of the frame abutment features 90 may be received within the elongated slots 170, while innermost non-contiguous lateral movement restriction surfaces 110 may remain free of containment within the slots 170. Thus, the elongated slots 170 may have a width $w_1$ corresponding to a width $w_2$ (FIG. 4) of the outermost non-continuous lateral movement restriction surfaces 111. However, according to alternative embodiments, the width $w_1$ of each of the elongated slots 170 may correspond to an entire width of each of the frame abutment features 90, as defined by the outermost surfaces 132 and 134.

Although the elongated slots 170 may have a height corresponding to the uniform thickness tx of the wear plates 94-104, according to some embodiments, each of the elongated slots 170 may define a height h greater than the uniform thickness tx of the wear plates 94-104. Further, according to such embodiments, each of the elongated slots 170 may be positioned relative to the feeder floor 46 such that the portion of each frame abutment feature 90 positioned through the slots 170 is closer to a top edge 172 of the slot 170 than a bottom edge 174 of the slot 170. Thus, the expanded height h of the elongated slots 170 may improve insertion of, at least portions of, the frame abutment features 90, particularly when inserted at an angle, while still providing vertical movement restriction, as will be described below.

Figure 7:
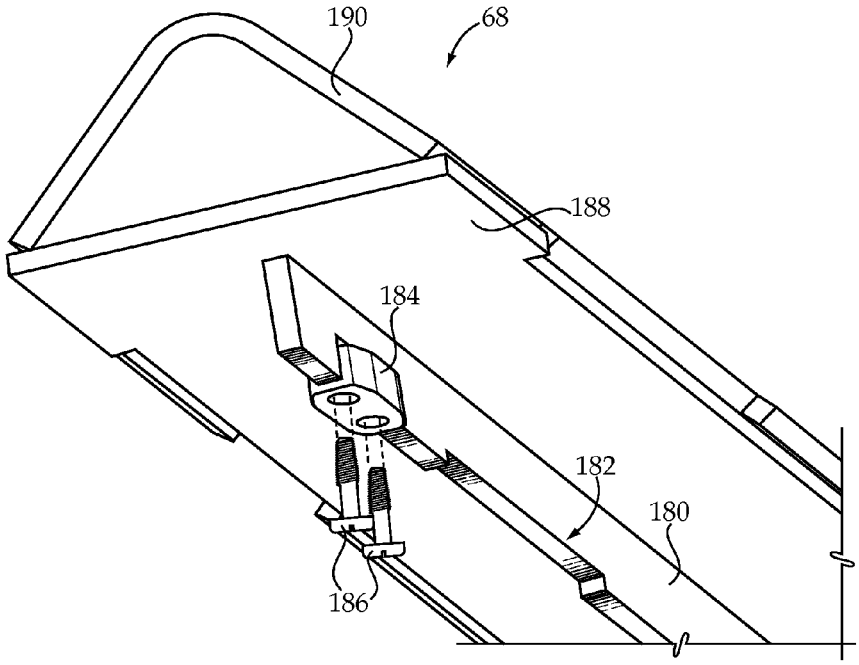
FIG. 7 is a perspective view of an end of one of the center guards of the feeder floor protection system of FIGS. 3 and 4, according to another aspect of the present disclosure.

The center guards 68 are received within the cavities 130 and extend over the plate abutment features 92 of each wear plate 94-104. More specifically, and as shown in FIG. 7, each center guard 68, any number of which may be used, may include a bridge portion 180, which may have an orientation transverse to the feeder floor 46 and wear plates 94-104, that is at least partially received within the cavities 130 and includes cutouts 182 accommodating the plate abutment features 92. Thus, the bridge portion 180 may be positioned between adjoining sides 126 and 128 of the wear plates 94-104 and over abutting plate abutment features 92. The bridge portion 180 may also include a plurality of fastener receptacles 184 secured to the bridge portion 180, such as by welding, and configured to receive a set of fasteners, such as fasteners 186. For example, the fastener receptacles 184 may include bores having internal threads for receiving threaded bolts. The fasteners 186 may pass through the feeder floor 46 to secure the center guards 68 and, thus, feeder floor protection system 60 to the frame 20.

The center guards 68 may also include a chain guard plate 188, transverse to the bridge portion 180 and parallel to the feeder floor 46 and wear plates 94-104, for shielding portions of the slat chains 48. As should be appreciated by those skilled in the art, the chain guard plate 188, in combination with a material deflection surface 190, which may be welded to the chain guard plate 188, may function to divert paving material P toward central regions of the slat chains 48 to protect the sides, or chain portions, of the slat chains 48. Specifically, the one or more center guards 68 of the feeder floor protection system 60 may not only secure positioning of the wear plates 94-104 relative to the frame 20, but may also reduce exposure of portions of the slat chains 48 to paving material P and, thus, reduce wear or damage.

INDUSTRIAL APPLICABILITY

The present disclosure finds potential application in any machine that has surfaces subject to wear. Further, the disclosure may be specifically applicable to protection systems for conveyor system surfaces. Yet further, the present disclosure may be applicable to protection systems that include wear plates requiring periodic replacement. Such machines may include, but are not limited to, off-highway machines, such as paving machines, and other machines known in the art.

Referring generally to FIGS. 1-7, an exemplary paving machine 10 may include a tractor portion 12, which may generally include a power source 14, ground-engaging propulsion elements 16, and an operator control station 18 supported on a machine frame 20. A hopper 22 may be supported on a front portion 24 of the frame 20 for receiving a paving material P, such as from a dump truck traveling in front of the paving machine 10. A conveyor 26 may also be supported on the frame 20 and may convey the paving material P received within the hopper 22 to a screed 28 coupled with the paving machine 10 at a rear portion 30 of the frame 20. The screed 28 may be used to distribute and, at least partially, compact the paving material P into a mat on a desired paving surface S.

The hopper 22 may generally include two hopper walls 40 and 42 that are pivotable relative to the frame 20 to channel the paving material P, which may include a bituminous aggregate, toward a feeder 44. The feeder 44 may generally represent the conveyance area of the paving machine 10 along which the paving material P is received at the front portion 24 of the machine 10 and transferred to the rear portion 30 of the machine 10. The feeder 44 includes a feeder floor 46, which may be defined by the frame 20, and may extend from the hopper 22 to the screed 28. The conveyor 26 may include two parallel slat chains 48 having a plurality of transverse slats 50 connected therebetween. Each slat chain 48, for example, may be pulled by one or more sprockets, which may be mounted on a common shaft and driven by an appropriate power source. During operation of the conveyor 26, conveyor portions 52 are positioned above and moved along the feeder floor 46 to convey the paving material P through the feeder 44.

A feeder floor protection system, such as feeder floor protection system 60, is disclosed herein for protecting the feeder floor 46 from wear or damage. According to an exemplary embodiment, the feeder floor protection system 60 may include three wear plate pairs 62, 64, and 66, covering a majority of the feeder floor 46, and at least one center guard 68. Each wear plate 94-104 of the wear plate pairs 62, 64, and 66 includes two frame abutment features 90 and two plate abutment features 92. Each plate abutment feature 92 includes at least two non-contiguous lateral movement restriction surfaces 106, 107 offset from a centerline C of the paving machine 10 and at least one fore and aft movement restriction surface 108 in a plane, such as plane P, perpendicular, or transverse, to the centerline C. As described above, the respective surfaces "abut" such that the lateral movement restriction surfaces 106 and 107 restrict movement of the wear plates 94-104 perpendicular to the centerline C, and the fore and aft movement restriction surfaces 108 restrict movement of the wear plates 94-104 parallel to the centerline C.

The frame abutment features 90 may be similar to the plate abutment features 92 and may include at least two non-contiguous lateral movement restriction surfaces 110 and 111, which are parallel with the centerline C and at least one fore and aft movement restriction surface 112, which lies in a plane, such as plane P, perpendicular, or transverse, to the centerline C. At least a portion of the frame abutment features 90 of each wear plate 94-104 may be received within elongated slots 170 formed in the frame 20. As described above, the elongated slots 170 may be sized and positioned to restrict fore and aft movement and/or vertical movement of the wear plates 94-104.

The frame abutment features 90 and plate abutment features 92 interlock, or engage, the wear plates 94-104 with the frame 20 and with another of the wear plates 94-104 to restrict movement and shifting of the wear plates 94-104 during operation of the paving machine 10. For example, the frame abutment features 90 and plate abutment features 92 restrict at least lateral movement, i.e., movement perpendicular to the centerline C, and fore and aft movement, i.e., movement parallel to the centerline C, of the wear plates 94-104. By interlocking, or engaging, the wear plates 94-104 with another of the wear plates 94-104 using the plate abutment features 92, in a manner described herein, each wear plate 94-104 is indirectly restricted from movement using the elongated slots 170 on either side of the frame 20. Thus, the interlocking nature of the plate abutment features 92 may provide a more stable design when compared to conventional systems.

As shown, each frame abutment feature 90 may have an identical longitudinal position as one of the plate abutment features 92. Further, the frame abutment features 90 and plate abutment features 92 that have a common longitudinal position may have reversed profiles relative to one another. Thus, the wear plates 94-104 in each pair 62, 64, and 66 may be identical to one another, but may be asymmetrical about a longitudinal axis $L_1$ or $L_2$. As such, the wear plates 94-104 within each pair 62, 64, and 66 may be interchangeable with one another. Such interchangeability may ease manufacturing burdens and may improve installation.

Further, the wear plates 94-104 described herein are free of openings through the wear plates 94-104. Thus, the feeder floor protection system 60 of the present disclosure may be fastened to the frame 20 exclusively with a set of fasteners, such as fasteners 186, anchoring the center guards 68 to the frame 20. Thus, the disclosed feeder floor protection system 60 may have a reduced number of fasteners, such as hardware fasteners, compared to conventional systems and, as a result, may offer improved installation and replacement and, thus, lower costs. Specifically, the elimination of hardware for fastening the wear plates 94-104 directly to the frame 20 may greatly reduce machine downtime for wear plate installation and replacement. Further, the present feeder floor protection system 60 eliminates hardware that is exposed to paving material and, thus, reduces the time necessary for cleaning up around the hardware before it can be removed.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

The invention claimed is:

1. A paving machine, comprising:

a frame;

a hopper supported on a front portion of the frame and configured to channel paving material toward a feeder;

a screed coupled with the paving machine at a rear portion of the frame;

the feeder including a feeder floor and extending from the hopper to the screed;

a conveyor having a conveyor portion positioned above the feeder floor for conveying the paving material through the feeder; and a feeder floor protection system including at least a first pair of wear plates covering a majority of the feeder floor, wherein each wear plate has at least two frame abutment features and at least two plate abutment features, wherein each plate abutment feature includes at least two non-contiguous lateral movement restriction surfaces offset from a centerline of the paving machine and at least one fore and aft movement restriction surface in a plane perpendicular to the centerline, wherein the lateral movement restriction surfaces of a first plate of the pair of wear plates abut the lateral movement restriction surfaces of a second plate of the pair of wear plates, and the fore and aft movement restriction surface of the first plate abuts the fore and aft movement restriction surface of the second plate;

wherein the lateral movement restriction surfaces restrict movement of the wear plates perpendicular to the centerline, and the fore and aft movement restriction surfaces restrict movement of the wear plates parallel to the centerline.

2. The paving machine of claim 1, further including a plurality of cavities defined by the feeder floor, adjoining sides of the wear plates, and the plate abutment features of each wear plate, wherein a center guard is received within the cavities and extends over the plate abutment features of each wear plate.

3. The paving machine of claim 2, wherein the feeder floor protection system is fastened to the frame exclusively with a set of fasteners anchoring the center guard to the frame.

4. The paving machine of claim 2, wherein at least a portion of the frame abutment features of each wear plate is received within elongated slots formed in the frame.

5. The paving machine of claim 4, wherein each of the slots defines a height greater than a uniform thickness of the wear plates, and each of the slots is positioned relative to the feeder floor such that the portion of each frame abutment feature is closer to a top edge of the slot than a bottom edge of the slot.

6. The paving machine of claim 4, wherein a first frame abutment feature and a first plate abutment feature have a first identical longitudinal position along the centerline, and a second frame abutment feature and a second plate abutment feature have a second identical longitudinal position along the centerline.

7. The paving machine of claim 6, wherein the first frame abutment feature has a reversed profile relative to the first plate abutment feature, and the second frame abutment feature has a reversed profile relative to the second plate abutment feature.

8. The paving machine of claim 7, wherein the wear plates are identical.

9. The paving machine of claim 8, wherein the feeder floor protection system includes a second pair of wear plates axially aligned with the first pair of wear plates, wherein the wear plates of the second pair of wear plates are identical.

10. A feeder floor protection system for a paving machine, the paving machine including a frame, a hopper supported on a front portion of the frame and configured to channel paving material toward a feeder, a screed coupled with the paving machine at a rear portion of the frame, the feeder including a feeder floor and extending from the hopper to the screed, and a conveyor having a conveyor portion positioned above the feeder floor for conveying the paving material through the feeder, the feeder floor protection system comprising:

a wear plate having a uniform thickness and including a planar conveyor contact surface and a planar feeder floor contact surface, wherein the conveyor contact surface and the feeder floor contact surface are bounded by a perimeter; and at least two frame abutment features and at least two plate abutment features defining a portion of the perimeter, wherein the frame abutment features and the plate abutment features are positioned on opposite sides of a longitudinal axis of the wear plate;

wherein each of the frame abutment features and the plate abutment features includes at least two non-contiguous lateral movement restriction surfaces parallel with the longitudinal axis and at least one fore and aft movement restriction surface in a plane perpendicular to the longitudinal axis;

wherein a first frame abutment feature and a first plate abutment feature have a first identical longitudinal position along the longitudinal axis, and a second frame abutment feature and a second plate abutment feature have a second identical longitudinal position along the longitudinal axis;

wherein the first frame abutment feature has a reversed profile relative to the first plate abutment feature, and the second frame abutment feature has a reversed profile relative to the second plate abutment feature such that the wear plate is asymmetrical about the longitudinal axis.

11. The feeder floor protection system of claim 10, wherein the wear plate is free of openings through the wear plate.

12. The feeder floor protection system of claim 11, wherein the wear plate is rectangular.

13. The feeder floor protection system of claim 12, wherein the wear plate includes at least one orthogonal cutout defining a corner of the wear plate.

14. The feeder floor protection system of claim 12, wherein the wear plate is a first wear plate in a pair of wear plates, wherein the feeder floor protection system further includes a second wear plate in the pair of wear plates that is identical to the first wear plate.

15. The feeder floor protection system of claim 14, further including a center guard including a bridge portion, wherein the bridge portion is shaped to be received within cavities defined by the feeder floor, adjoining sides of the first and second wear plates, in an installed configuration, and the plate abutment features of each wear plate, wherein the bridge portion also extends over the plate abutment features of each wear plate.

16. A method of protecting a feeder floor of a paving machine, the paving machine including a frame, a hopper supported on a front portion of the frame and configured to channel paving material toward a feeder, a screed coupled with the paving machine at a rear portion of the frame, the feeder including the feeder floor and extending from the hopper to the screed, and a conveyor having a conveyor portion positioned above the feeder floor for conveying the paving material through the feeder, the method comprising steps of:

disposing at least a first pair of wear plates of a feeder floor protection system to cover a majority of the feeder floor, wherein each wear plate has at least two frame abutment features and at least two plate abutment features;

restricting lateral movement of the wear plates relative to a centerline of the paving machine using non-contiguous lateral movement restriction surfaces of the plate abutment features of each wear plate, wherein the lateral movement restriction surfaces are offset from the centerline; and restricting fore and aft movement of the wear plates relative to the centerline using fore and aft movement restriction surfaces of the plate abutment features of each wear plate, wherein the fore and aft movement restriction surfaces are in a plane perpendicular to the centerline.

17. The method of claim 16, wherein the disposing step includes inserting a portion of the frame abutment features into elongated slots formed in the frame.

18. The method of claim 17, further including positioning a bridge portion of a center guard over the plate abutment features of each wear plate and within cavities defined by the feeder floor, adjoining sides of the wear plates, and the plate abutment features of each wear plate.

19. The method of claim 18, further including fastening the feeder floor protection system to the frame exclusively with a set of fasteners anchoring the center guard to the frame.

20. The method of claim 19, further including disposing a second set of wear plates in axial alignment with the first set of wear plates to cover the feeder floor.

* * * * *